US012066227B2

(12) United States Patent
Iyoshi et al.

(10) Patent No.: US 12,066,227 B2
(45) Date of Patent: Aug. 20, 2024

(54) AIR-CONDITIONING MANAGEMENT SYSTEM AND REFRIGERANT RECOVERY MANAGEMENT APPARATUS

(71) Applicant: DAIKIN INDUSTRIES, LTD., Osaka (JP)

(72) Inventors: Yuuta Iyoshi, Osaka (JP); Yoshiki Yamanoi, Osaka (JP); Kumiko Saeki, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 208 days.

(21) Appl. No.: 17/891,962

(22) Filed: Aug. 19, 2022

(65) Prior Publication Data

US 2022/0390159 A1 Dec. 8, 2022

Related U.S. Application Data

(63) Continuation of application No. PCT/JP2021/010732, filed on Mar. 17, 2021.

(30) Foreign Application Priority Data

Apr. 27, 2020 (JP) ..... 2020-078286

(51) Int. Cl.
*F25B 45/00* (2006.01)
*F25B 49/02* (2006.01)

(52) U.S. Cl.
CPC ..... *F25B 45/00* (2013.01); *F25B 49/02* (2013.01); *F25B 2345/002* (2013.01); *F25B 2345/003* (2013.01); *F25B 2700/04* (2013.01)

(58) Field of Classification Search
CPC .... F25B 45/00; F25B 49/02; F25B 2345/002; F25B 2345/003; F25B 13/00; F25B 2313/0233; F25B 2400/19; F24F 11/32
See application file for complete search history.

(56) References Cited

U.S. PATENT DOCUMENTS 5,243,828 A * 9/1993 Paige ..... F25B 45/00 62/149
5,802,859 A * 9/1998 Zugibe ..... G01G 17/06 62/149

(Continued)

FOREIGN PATENT DOCUMENTS

CN 101424469 A * 5/2009 ..... F25B 45/00
EP 3 333 508 A1 6/2018

(Continued)

OTHER PUBLICATIONS

International Search Report for PCT/JP2021/010732 (PCT/ISA/210) mailed on May 18, 2021.

(Continued)

*Primary Examiner* — Kun Kai Ma
(74) *Attorney, Agent, or Firm* — Birch, Stewart, Kolasch & Birch, LLP

(57) ABSTRACT

An air-conditioning management system includes: an air conditioning apparatus configured to carry out a refrigerant recovery operation of recovering a refrigerant from a refrigerant circuit that connects an outdoor unit and an indoor unit and sending the recovered refrigerant to each recovery unit of the outdoor unit; and a control unit configured to make a determination whether all the recovered refrigerant is sendable to each recovery unit before a start of the refrigerant recovery operation by the air conditioning apparatus, and to output, when determining that all the recovered refrigerant is not sendable to each recovery unit, a command for notifying the determination.

20 Claims, 5 Drawing Sheets

(56) References Cited

U.S. PATENT DOCUMENTS

| | | | | |
|---|---|---|---|---|
| 6,427,457 | B1 * | 8/2002 | Pfefferle | B60H 1/00585 62/149 |
| 2013/0074960 | A1 * | 3/2013 | Sundheim | F25B 45/00 137/565.29 |
| 2013/0205806 | A1 * | 8/2013 | McMasters | B60H 1/00585 62/125 |
| 2016/0187042 | A1 * | 6/2016 | Brown | F25B 45/00 62/77 |
| 2018/0120008 | A1 * | 5/2018 | Brown | F25B 45/00 |
| 2018/0363963 | A1 * | 12/2018 | Govekar | F25B 45/00 |

FOREIGN PATENT DOCUMENTS

| | | | | |
|---|---|---|---|---|
| JP | H076711 | B2 * | 1/1995 | |
| JP | 8-200896 | A | 8/1996 | |
| JP | 2004-116885 | A | 4/2004 | |
| JP | 2015-49024 | A | 3/2015 | |
| JP | 2015-87071 | A | 5/2015 | |
| JP | 2017026182 | A * | 2/2017 | |
| WO | WO-2018105039 | A1 * | 6/2018 | |
| WO | WO-2018167811 | A1 * | 9/2018 | F16K 11/10 |
| WO | WO-2020223948 | A1 * | 11/2020 | |

OTHER PUBLICATIONS

Extended European Search Report for European Application No. 21795704.2, dated Nov. 8, 2023.

English translation of International Preliminary Report on Patentability and Written Opinion of the International Searching Authority, for International Application No. PCT/JP2021/010732, dated Nov. 10, 2022.

* cited by examiner

AIR-CONDITIONING MANAGEMENT SYSTEM AND REFRIGERANT RECOVERY MANAGEMENT APPARATUS

CROSS REFERENCE TO RELATED APPLICATIONS

This application is a Continuation of PCT International Application No. PCT/JP2021/010732, filed on Mar. 17, 2021, which claims priority under 35 U.S.C. 119(a) to Patent Application No. 2020-078286, filed in Japan on Apr. 27, 2020, all of which are hereby expressly incorporated by reference into the present application.

TECHNICAL FIELD

The present disclosure relates to an air-conditioning management system and a refrigerant recovery management apparatus.

BACKGROUND ART

For example, in cases where an air conditioner is installed in a large construction such as a building, if a pipe length of a refrigerant circuit is too long, a refrigerant becomes insufficient, so that an additional refrigerant is occasionally supplied to the refrigerant circuit. It is conceivable in such a case that when a service engineer recovers the refrigerant from the refrigerant circuit and sends the refrigerant to an outdoor unit, he or she will fail to send all the refrigerant to the outdoor unit. Hence, Patent Literature 1 discloses an air conditioner having the following configuration. During a refrigerant recovery operation of sending a recovered refrigerant to a heat exchanger and an accumulator of an outdoor unit, when both the heat exchanger and the accumulator become full of the refrigerant, the air conditioner stops the refrigerant recovery operation.

CITATION LIST

Patent Literature

PATENT LITERATURE 1: Japanese Laid-Open Patent Publication No. 2015-87071

SUMMARY an air conditioning apparatus configured to carry out a refrigerant recovery operation of recovering a refrigerant from a refrigerant circuit that connects an outdoor unit and an indoor unit and sending the recovered refrigerant to a recovery unit of the outdoor unit; and a control unit configured to make a determination whether all the recovered refrigerant is sendable to the recovery unit before a start of the refrigerant recovery operation by the air conditioning apparatus, and to output, when determining that all the recovered refrigerant is not sendable to the recovery unit, a command for notifying the determination.

DETAILED DESCRIPTION

Embodiments will be described below with reference to the accompanying drawings.

Figure 1:
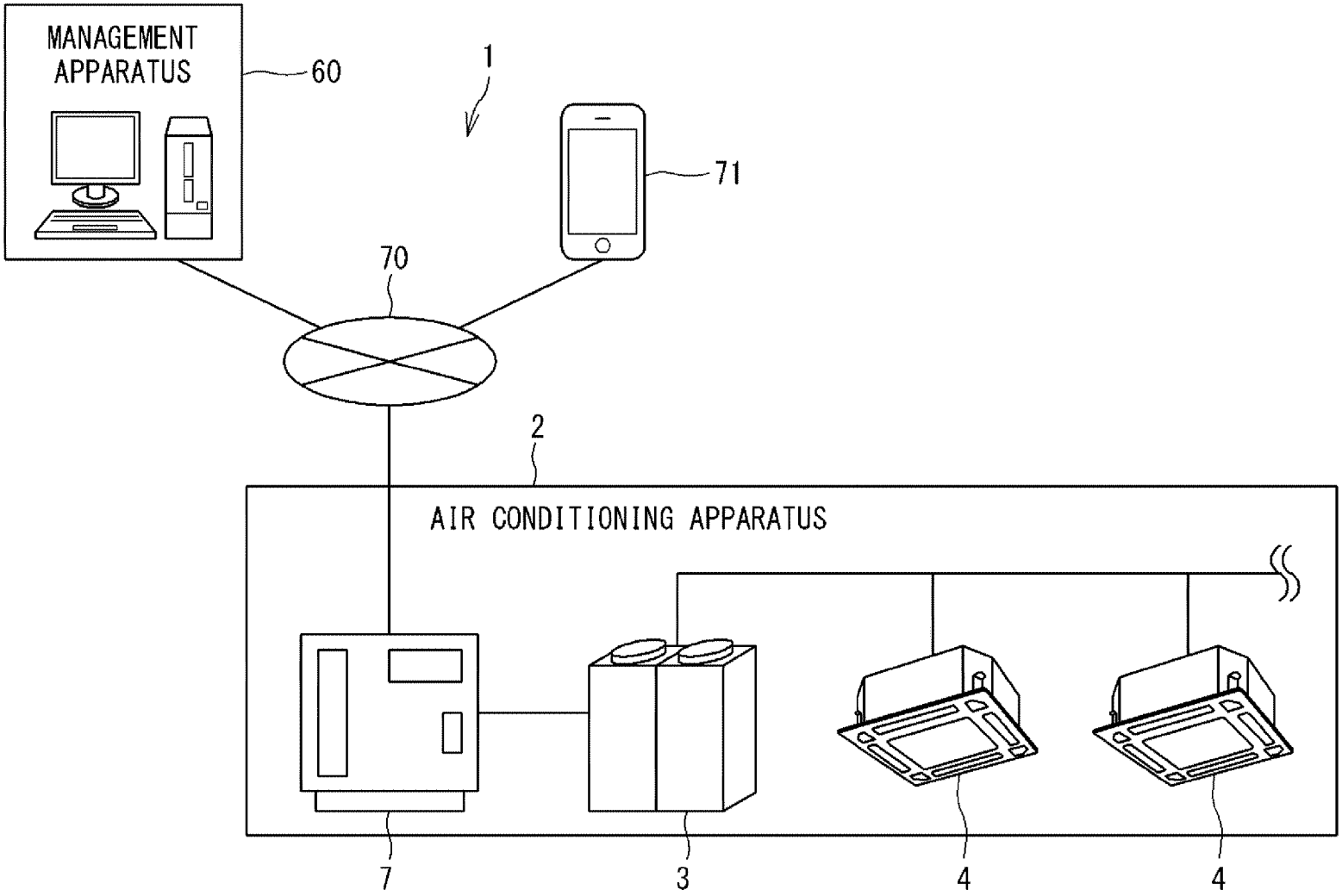
FIG. 1 is a schematic configuration diagram of an air-conditioning management system according to an embodiment.

FIG. 1 is a schematic configuration diagram of an air-conditioning management system according to an embodiment. An air-conditioning management system 1 includes an air conditioning apparatus 2 and a management apparatus 60. The air conditioning apparatus 2 and the management apparatus 60 are communicably connected via a network 70.

[Air Conditioning Apparatus]

Figure 2:
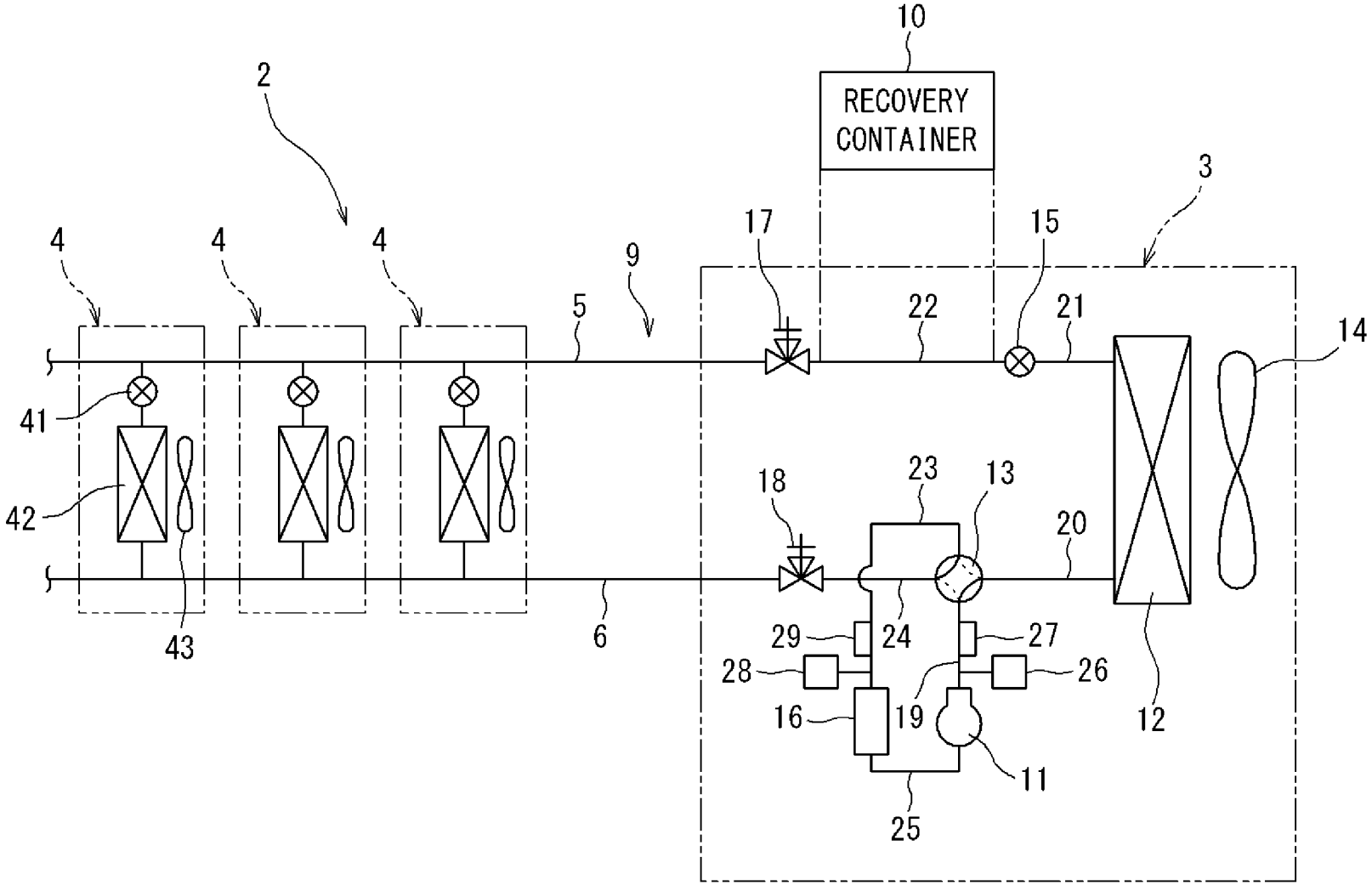
FIG. 2 is a schematic configuration diagram of an air conditioning apparatus according to the embodiment.

FIG. 2 is a schematic configuration diagram of the air conditioning apparatus 2 according to the embodiment. The air conditioning apparatus 2 is configured to cool and heat the interiors of rooms in a large construction such as a building, by a vapor compression refrigeration cycle. The air conditioning apparatus 2 includes an outdoor unit 3, a plurality of indoor units 4 (four indoor units 4 herein) connected in parallel, a liquid-refrigerant connection pipe 5, a gas-refrigerant connection pipe 6, and an air-conditioning controller 7 (see also FIG. 1). The air conditioning apparatus 2 may also include an intermediate unit that switches a flow of a refrigerant between the outdoor unit 3 and the plurality of indoor units 4. In this case, the intermediate unit may be installed outside a building or may be installed in, for example, a machine chamber in the building.

In the air conditioning apparatus 2, the outdoor unit 3 and the indoor units 4 are connected via the liquid-refrigerant connection pipe 5 and the gas-refrigerant connection pipe 6 to constitute a vapor compression refrigerant circuit 9. The refrigerant circuit 9 is filled with a refrigerant such as R32, $CO_2$, or HFO-based refrigerant.

[Outdoor Unit]

The outdoor unit 3 is installed outside the building and constitutes a part of the refrigerant circuit 9. The outdoor unit 3 includes a compressor 11, an outdoor heat exchanger 12, a four-way switching valve 13, an outdoor fan 14, an outdoor expansion valve 15, an accumulator 16, a liquid-side shutoff valve 17, and a gas-side shutoff valve 18. These components 11 to 16 as well as the valves 17 and 18 are connected with refrigerant pipes 19 to 25.

The compressor 11 is capable of changing the operating number of rotations of a motor (not illustrated) incorporated therein, by inverter control. The outdoor heat exchanger 12 is, for example, a cross-fin-and-tube heat exchanger to be used for heat exchange with the refrigerant, using air serving as a heat source.

The outdoor fan 14 includes a motor (not illustrated) of which the operating number of rotations is adjustable by inverter control. The outdoor fan 14 takes in outside air and provides the air into the outdoor unit 3. After the outdoor heat exchanger 12 exchanges heat with the air, the outdoor fan 14 blows the air out of the outdoor unit 3.

The four-way switching valve 13 reverses the flow of the refrigerant in the refrigerant circuit 9 to switch between the supply of the refrigerant from the compressor 11 to the outdoor heat exchanger 12 and the supply of the refrigerant from the compressor 11 to each indoor heat exchanger 42 (to be described later). The accumulator 16 temporarily stores the refrigerant to be sucked into the compressor 11. Each of the liquid-side shutoff valve 17 and the gas-side shutoff valve 18 is an electric valve. The operations of the compressor 11, four-way switching valve 13, outdoor fan 14, outdoor expansion valve 15, liquid-side shutoff valve 17, and gas-side shutoff valve 18 are controlled by an outdoor control unit 31 to be described later.

The outdoor unit 3 also includes a discharge pressure sensor 26, a discharge temperature sensor 27, a suction pressure sensor 28, and a suction temperature sensor 29.

The discharge pressure sensor 26 detects a pressure of the refrigerant discharged from the compressor 11. The discharge temperature sensor 27 detects a temperature of the refrigerant discharged from the compressor 11. The suction pressure sensor 28 detects a pressure of the refrigerant to be sucked into the compressor 11. The suction temperature sensor 29 detects a temperature of the refrigerant to be sucked into the compressor 11.

Figure 3:
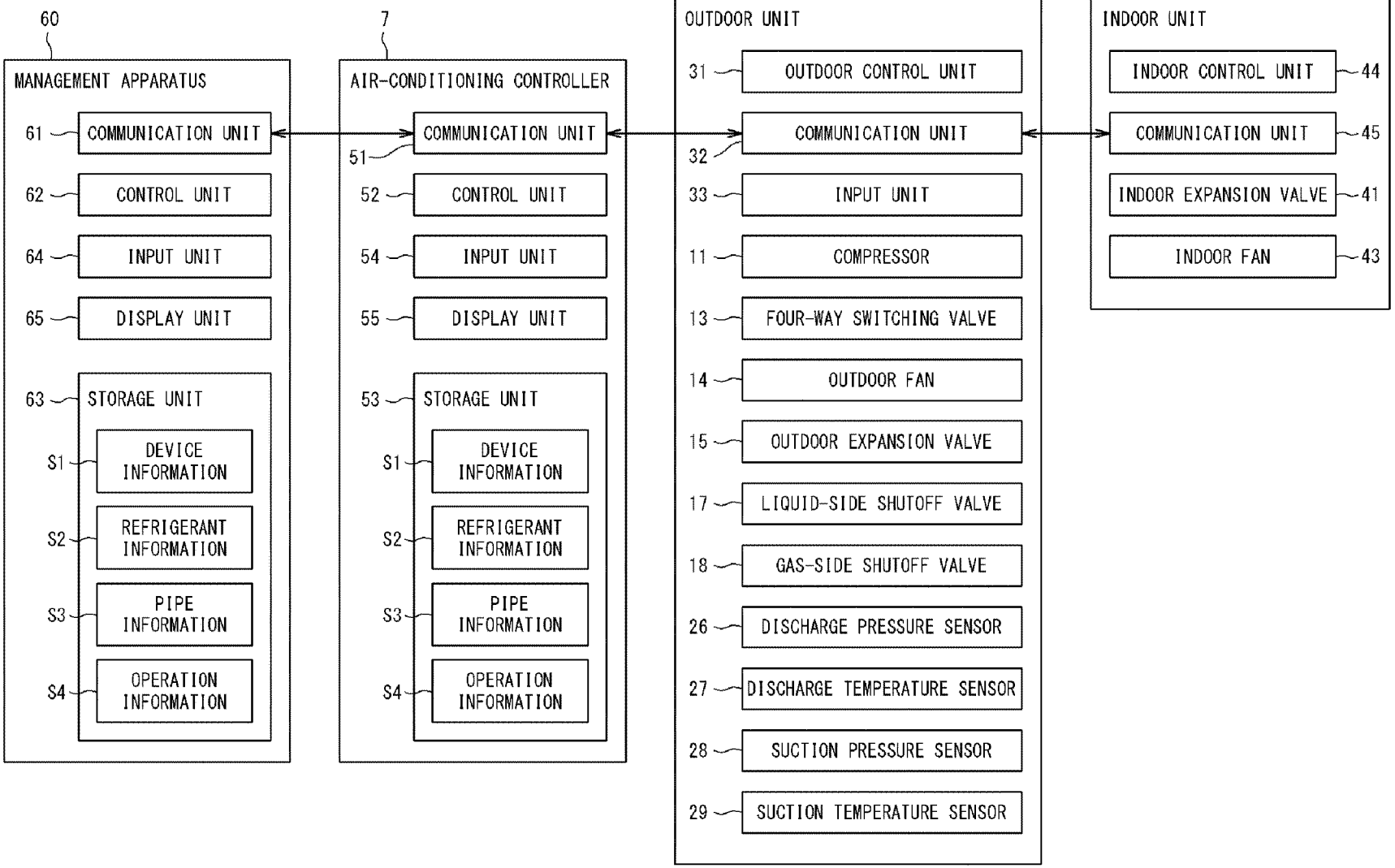
FIG. 3 is a block diagram illustrating exemplary internal configurations of an outdoor unit, indoor unit, air-conditioning controller, and management apparatus.

Signals detected by the various sensors 26 to 29 are input to the outdoor control unit 31 (see FIG. 3). The operations of the compressor 11, outdoor fan 14, and outdoor expansion valve 15 are controlled by the outdoor control unit 31 in accordance with the outputs from the various sensors 26 to 29.

[Indoor Unit]

Each indoor unit 4 is installed inside the building and constitutes a part of the refrigerant circuit 9. The indoor unit 4 includes an indoor expansion valve 41, the indoor heat exchanger 42, and an indoor fan 43.

The indoor expansion valve 41 is an electric expansion valve capable of adjusting a pressure of the refrigerant and a flow rate of the refrigerant. The indoor heat exchanger 42 is, for example, a cross-fin-and-tube heat exchanger to be used for heat exchange with indoor air.

The indoor fan 43 includes a motor (not illustrated) of which the operating number of rotations is adjustable by inverter control. The indoor fan 43 takes in indoor air and provides the air into the indoor unit 4. After the indoor heat exchanger 42 exchanges heat with the air, the indoor fan 43 blows out the air toward the room. The operations of the indoor expansion valve 41 and indoor fan 43 are controlled by an indoor control unit 44 to be described later.

The liquid-refrigerant connection pipe 5 has a first end connected to the liquid-side shutoff valve 17 of the outdoor unit 3 and a second end connected to a liquid-side end of the indoor expansion valve 41 of the indoor unit 4. The gas-refrigerant connection pipe 6 has a first end connected to the gas-side shutoff valve 18 of the outdoor unit 3 and a second end connected to a gas-side end of the indoor heat exchanger 42 of the indoor unit 4.

[Operation of Air Conditioning Apparatus]

The air conditioning apparatus 2 carries out a cooling operation, a heating operation, and a refrigerant recovery operation.

During the cooling operation, the outdoor heat exchanger 12 serves as an evaporator and each indoor heat exchanger 42 serves as a condenser. Specifically, the four-way switching valve 13 is switched to an outdoor heat radiation state (a state indicated by a solid line in FIG. 2), the liquid-side shutoff valve 17 and the gas-side shutoff valve 18 are opened, and the compressor 11, the outdoor fan 14, and each indoor fan 43 are driven.

The high-pressure refrigerant discharged from the compressor 11 passes through the four-way switching valve 13, the outdoor heat exchanger 12, the outdoor expansion valve 15, and the liquid-side shutoff valve 17, and then flows out of the outdoor unit 3. After the refrigerant flows out of the outdoor unit 3, the refrigerant passes through the liquid-refrigerant connection pipe 5 and then flows into the plurality of indoor units 4 while being branched. The refrigerants thus branched pass through the indoor expansion valves 41 and indoor heat exchangers 42 of the respective indoor units 4. The refrigerants are then merged into one to pass through the gas-refrigerant connection pipe 6. The merged refrigerant then flows into the outdoor unit 3. Thereafter, the refrigerant passes through the gas-side shutoff valve 18, the four-way switching valve 13, and the accumulator 16 and then is sucked into the compressor 11.

During the heating operation, the outdoor heat exchanger 12 serves as a condenser and each indoor heat exchanger 42 serves as an evaporator. Specifically, the four-way switching valve 13 is switched to an outdoor evaporation state (a state indicated by a broken line in FIG. 2), the liquid-side shutoff valve 17 and the gas-side shutoff valve 18 are opened, and the compressor 11, the outdoor fan 14, and each indoor fan 43 are driven.

The high-pressure refrigerant discharged from the compressor 11 passes through the four-way switching valve 13 and the gas-side shutoff valve 18, and then flows out of the outdoor unit 3. After the refrigerant flows out of the outdoor unit 3, the refrigerant passes through the gas-refrigerant connection pipe 6 and then flows into the plurality of indoor units 4 while being branched. The refrigerants thus branched pass through the indoor heat exchangers 42 and indoor expansion valves 41 of the respective indoor units 4. The refrigerants are then merged into one to pass through the liquid-refrigerant connection pipe 5. The merged refrigerant then flows into the outdoor unit 3. Thereafter, the refrigerant passes through the liquid-side shutoff valve 17, the outdoor expansion valve 15, the outdoor heat exchanger 12, the four-way switching valve 13, and the accumulator 16 and then is sucked into the compressor 11.

The refrigerant recovery operation is carried out in recovering the refrigerant from the refrigerant circuit 9 and then sending the recovered refrigerant to the outdoor unit 3. During the refrigerant recovery operation, the outdoor heat exchanger 12 and accumulator 16 of the outdoor unit 3 each function as a recovery unit that recovers the refrigerant from the refrigerant circuit 9. The "recovery unit" that recovers the refrigerant from the refrigerant circuit 9 is a default component of the outdoor unit 3 and does not include a recovery container 10 to be described later. In the following description, the outdoor heat exchanger 12 and the accumulator 16 will also be referred to as the recovery units 12 and 16.

During the refrigerant recovery operation, the four-way switching valve 13 is switched to the outdoor heat radiation state similarly to the cooling operation, the liquid-side shutoff valve 17 is closed, and the gas-side shutoff valve 18 is opened. Then, the compressor 11, the outdoor fan 14, and each indoor fan 43 are driven.

When the compressor 11 is driven, the refrigerant retained in the refrigerant pipe 22, liquid-refrigerant connection pipe 5, indoor expansion valves 41, indoor heat exchangers 42, and gas-refrigerant connection pipe 6 of the refrigerant circuit 9 passes through the gas-side shutoff valve 18 and the four-way switching valve 13 and then flows into the accumulator 16. With regard to the refrigerant flowing into the accumulator 16, the liquid refrigerant is retained in the accumulator 16 while the gas refrigerant is sucked into the compressor 11. The gas refrigerant sucked into the compressor 11 then flows into the outdoor heat exchanger 12 via the four-way switching valve 13. When the gas refrigerant flows into the outdoor heat exchanger 12, then the gas refrigerant flows toward the liquid-side shutoff valve 17. However, since the liquid-side shutoff valve 17 is closed, the refrigerant accumulates in the outdoor heat exchanger 12. The refrigerant is thus recovered from the refrigerant circuit 9 and is sent to the recovery units 12 and 16 of the outdoor unit 3.

After completion of the recovery of the refrigerant sent to the recovery units 12 and 16, the compressor 11, outdoor fan 14, and indoor fans 43 being driven are stopped, and the gas-side shutoff valve 18 is closed. Closing the gas-side shutoff valve 18 inhibits the recovered refrigerant sent to the recovery units 12 and 16 from flowing toward the indoor units 4.

FIG. 3 is a block diagram illustrating an exemplary internal configuration of the outdoor unit 3, an exemplary internal configuration of one of the indoor units 4, an exemplary internal configuration of the air-conditioning controller 7, and an exemplary internal configuration of the management apparatus 60.

[Internal Configuration of Indoor Unit]

Each indoor unit 4 includes the indoor control unit 44 and a communication unit 45. The communication unit 45 includes a communication interface and exchanges various kinds of information with the outdoor control unit 31. The indoor control unit 44 is a microcomputer including, for example, a CPU and a memory. The indoor control unit 44 controls the indoor expansion valve 41 and the indoor fan 43, based on commands from the outdoor control unit 31.

[Internal Configuration of Outdoor Unit]

The outdoor unit 3 includes the outdoor control unit 31, a communication unit 32, and an input unit 33.

The communication unit 32 includes a communication interface and exchanges various kinds of information with the communication unit 45 of each indoor unit 4. The input unit 33 includes, for example, a DIP switch mounted on a board and sets operation to the outdoor unit 3 and attachment of the recovery container 10 to the refrigerant circuit 9.

The outdoor control unit 31 is a microcomputer including, for example, a CPU and a memory. The outdoor control unit 31 controls the various constituent components of the outdoor unit 3 and the various constituent components of each indoor unit 4, based on, for example, detection signals of the various sensors described above, thereby controlling the cooling operation and heating operation of the air conditioning apparatus 2.

[Air-Conditioning Controller]

The air-conditioning controller 7 collectively manages the outdoor unit 3 and the plurality of indoor units 4. The air-conditioning controller 7 includes a communication unit 51, a control unit 52, a storage unit 53, an input unit 54, and a display unit 55.

The communication unit 51 includes a communication interface and exchanges various kinds of information with the communication unit 32 of the outdoor unit 3. The communication unit 51 also exchanges various kinds of information with the management apparatus 60 via the network 70 (see FIG. 1).

The input unit 54 includes, for example, a touch screen, various input buttons, or the like for receiving an operation input. The display unit 55 includes, for example, a liquid crystal display panel.

The storage unit 53 includes a RAM, a ROM, a flash memory, and the like. The storage unit 53 stores, for example, device information S1, refrigerant information S2, pipe information S3, and operation information S4 on the air conditioning apparatus 2.

The device information S1 indicates, for example, the number of outdoor units 3 and the number of indoor units 4. The refrigerant information S2 indicates whether an additional refrigerant is supplied to the refrigerant circuit 9 in installing the air conditioning apparatus 2.

The pipe information S3 indicates a total pipe length of the refrigerant circuit 9. The operation information S4 contains signals detected by the various sensors 26 to 29, start information, end information, full occupancy information, and the like. The operation information S4 is stored in the storage unit 53 every several minutes, for example. The start information indicates a start of the refrigerant recovery operation. The end information indicates an end of the refrigerant recovery operation. The full occupancy information indicates that the recovery units 12 and 16 become full of the refrigerant.

The control unit 52 is practicable using a CPU. The control unit 52 controls the refrigerant recovery operation of the air conditioning apparatus 2, based on a control command from the management apparatus 60. The control unit 52 allows the communication unit 51 to transmit to the management apparatus 60 the various kinds of information S1 to S4 stored in the storage unit 53 every several minutes, for example.

[Management Apparatus]

The management apparatus 60 is operated by, for example, a vendor of the air conditioning apparatus 2 or a proprietary company that undertakes maintenance, inspection, and the like for the air conditioning apparatus 2. The management apparatus 60 functions as a refrigerant recovery management apparatus that manages the refrigerant recovery operation of the air conditioning apparatus 2.

When the management apparatus 60 receives an instruction to carry out the refrigerant recovery operation from a terminal 71 (see FIG. 1) used by a participant, such as a manager, a user, a service engineer, or a manufacturer, of the air conditioning apparatus 2, the management apparatus 60 then transmits information on the refrigerant recovery operation to the terminal 71 of the participant. Examples of the terminal 71 may include, but not limited to, a personal computer, a tablet PC, and a smartphone each connectable to the management apparatus 60 via the network 70.

The management apparatus 60 includes a communication unit 61, a control unit 62, a storage unit 63, an input unit 64, and a display unit 65.

The communication unit 61 includes a communication interface and exchanges various kinds of information with the air-conditioning controller 7 and with the terminal 71 via the network 70 (see FIG. 1).

The storage unit 63 includes a RAM, a ROM, a flash memory, and the like. The storage unit 63 stores the device information S1, the refrigerant information S2, the pipe information S3, and the operation information S4 each received by the communication unit 61 from the air-conditioning controller 7.

The input unit 64 includes, for example, a keyboard and a touch screen, and performs operation and setting on the management apparatus 60. The display unit 65 includes, for example, a display.

The control unit 62 is practicable using a CPU. Before the air conditioning apparatus 2 starts to carry out the refrigerant recovery operation, the control unit 62 makes a determination whether all the refrigerant recovered from the refrigerant circuit 9 is sendable to the recovery units 12 and 16, based on the information stored in the storage unit 63.

This determination is made based on, for example, the refrigerant information S2 stored in the storage unit 63. Specifically, when the refrigerant information S2 indicates that no refrigerant is additionally supplied to the refrigerant circuit 9, the control unit 62 determines that all the recovered refrigerant is sendable to the recovery units 12 and 16. Alternatively, when the refrigerant information S2 indicates that a refrigerant is additionally supplied to the refrigerant circuit 9, the control unit 62 determines that all the recovered refrigerant is not sendable to the recovery units 12 and 16.

The control unit 62 may make a determination, based on the pipe information S3 stored in the storage unit 63. For example, when the pipe information S3 indicates that the total pipe length of refrigerant circuit 9 has a value less than a threshold value, the control unit 62 determines that all the recovered refrigerant is sendable to the recovery units 12 and 16. Alternatively, when the pipe information S3 indicates that the total pipe length of refrigerant circuit 9 has a value equal to or more than the threshold value, the control unit 62 determines that all the recovered refrigerant is not sendable to the recovery units 12 and 16.

The control unit 62 may make a determination, based on the device information S1 stored in the storage unit 63. For example, when the device information S1 indicates that the total number of outdoor units 3 and indoor units 4, calculated from the device information S1, has a value less than a threshold value, the control unit 62 determines that all the recovered refrigerant is sendable to the recovery units 12 and 16. Alternatively, when the device information S1 indicates that the total number of outdoor units 3 and indoor units 4, calculated from the device information S1, has a value equal to or more than the threshold value, the control unit 62 determines that all the recovered refrigerant is not sendable to the recovery units 12 and 16.

The control unit 62 may make a determination, based on at least two of the device information S1, the refrigerant information S2, and the pipe information S3.

When the control unit 62 determines that all the recovered refrigerant is not sendable to the recovery units 12 and 16, the control unit 62 outputs a command for notifying this determination (a notification command). The control unit 62 allows the communication unit 61 to transmit the command to the terminal 71 of the participant such as the service engineer (hereinafter, referred to as simply "the service engineer or the like") via the network 70.

The control unit 62 determines whether the recovery container 10 (see FIG. 2) capable of recovering the refrigerant is attached to the refrigerant circuit 9 independently of the recovery units 12 and 16 of the outdoor unit 3. This determination can be made based on, for example, whether the input unit 33 of the outdoor unit 3 has received an operation input for setting connection of the recovery container to the refrigerant circuit 9. For example, the device information S1 contains an operation input signal of the input unit 33. The control unit 62 is therefore capable of making the determination, based on the device information S1 stored in the storage unit 63.

It should be noted that the control unit 62 may make the determination, based on whether the discharge pressure sensor 26 or the suction pressure sensor 28 has detected a pressure fluctuation occurring when the recovery container is connected to the refrigerant circuit 9, in accordance with a detection signal from the discharge pressure sensor 26 or suction pressure sensor 28, the detection signal being contained in the operation information S4 stored in the storage unit 63. The determination may alternatively be made by the control unit 52 of the air-conditioning controller 7.

When the control unit 62 determines that the recovery container 10 is attached to the refrigerant circuit 9, the control unit 62 outputs a command for starting the refrigerant recovery operation (a start command). This command is transmitted from the communication unit 61 to the air-conditioning controller 7 via the network 70.

[Control on Refrigerant Recovery Operation]

Figure 4:
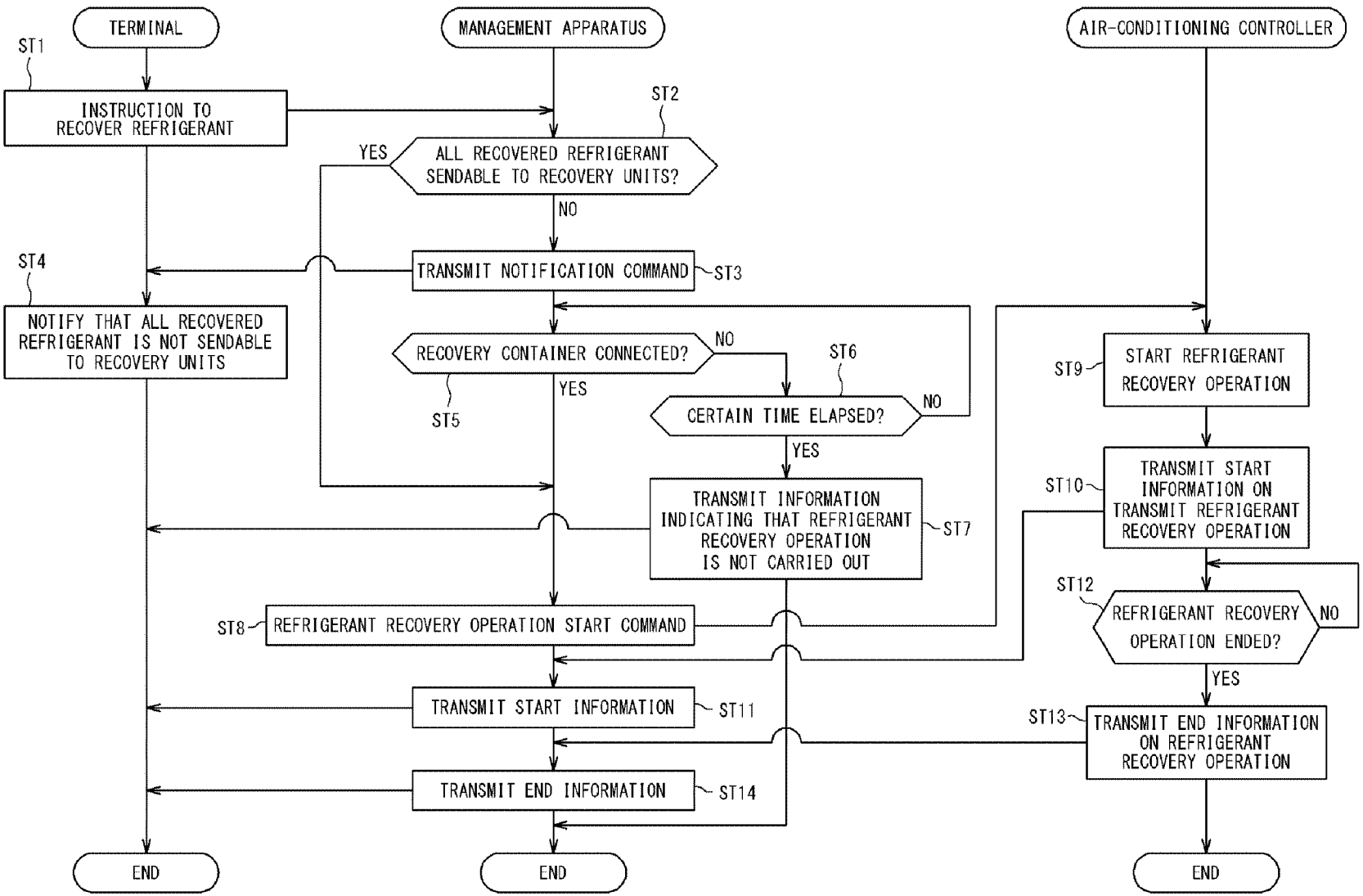
FIG. 4 is a sequence diagram illustrating a control example during a refrigerant recovery operation in the air-conditioning management system.

FIG. 4 is a sequence diagram illustrating a control example during the refrigerant recovery operation in the air-conditioning management system 1. This control example describes a case where the air conditioning apparatus 2 carries out the refrigerant recovery operation when the service engineer or the like operates the terminal 71.

The service engineer or the like transmits, through the terminal 71, an instruction to recover the refrigerant in the air conditioning apparatus 2 to the management apparatus 60 (step ST1). When the management apparatus 60 receives the instruction from the terminal 71, the management apparatus 60 determines whether all the refrigerant recovered from the refrigerant circuit 9 is sendable to the recovery units 12 and 16 (step ST2). The specific determination method has already been described above.

When the management apparatus 60 determines that all the recovered refrigerant is sendable to the recovery units 12 and 16 ("Yes" in step ST2), the processing proceeds to step ST8 to be described later. On the other hand, when the management apparatus 60 determines that all the recovered refrigerant is not sendable to the recovery units 12 and 16 ("No" in step ST2), the management apparatus 60 transmits a notification command for notifying this determination to the terminal 71 (step ST3).

The terminal 71 notifies, based on the notification command received from the management apparatus 60, the service engineer or the like that all the recovered refrigerant is not sendable to the recovery units 12 and 16, by phonetic representation, textural representation, or the like (step ST4). The service engineer or the like is thus able to know that all the recovered refrigerant is not sendable to the recovery units 12 and 16.

The management apparatus 60 determines whether the recovery container is attached to the refrigerant circuit 9, after transmitting the notification command to the terminal 71 (step ST5). The determination method has already been described above.

When the management apparatus 60 determines that the recovery container 10 is not attached to the refrigerant circuit 9 ("No" in step ST5), the management apparatus 60 confirms whether a certain time (a timeout period) has elapsed (step ST6).

When the certain time has not elapsed ("No" in step ST6), the management apparatus 60 repeatedly makes a determination in step ST5. When the certain time has elapsed ("Yes" in step ST6), the management apparatus 60 determines that the recovered refrigerant is not sendable to the recovery container 10. The management apparatus 60 then transmits to the terminal 71 information indicating that the refrigerant recovery operation is not carried out (step ST7). The processing thus ends. When the terminal 71 receives the information, the service engineer or the like is able to know that the refrigerant recovery operation is not carried out.

On the other hand, when the management apparatus 60 determines that the recovery container 10 is attached to the refrigerant circuit 9 ("Yes" in step ST5), the management apparatus 60 transmits to the air-conditioning controller 7 a start command for starting the refrigerant recovery operation (step ST8).

When the air-conditioning controller 7 receives the start command, the air-conditioning controller 7 starts the refrigerant recovery operation of the air conditioning apparatus 2 (step ST9). The air-conditioning controller 7 then transmits to the management apparatus 60 start information indicating that the air conditioning apparatus 2 starts to carry out the refrigerant recovery operation (step ST10).

When the management apparatus 60 receives the start information from the air-conditioning controller 7, the management apparatus 60 transmits the start information to the terminal 71 (step ST11). When the terminal 71 receives the start information, the service engineer or the like is able to know that the refrigerant recovery operation has started.

The air-conditioning controller 7 determines whether the refrigerant recovery operation ends, after transmitting the start information (step ST12). In the air-conditioning controller 7 (see FIG. 3), specifically, the control unit 52 determines that the refrigerant recovery operation has ended, when the operation information S4 stored in the storage unit 53 indicates that, for example, a suction pressure detected by the suction pressure sensor 28 has a value equal to or less than a threshold value. The control unit 52 also determines that the refrigerant recovery operation has not ended yet, when the operation information S4 indicates that the suction pressure detected by the suction pressure sensor 28 has a value more than the threshold value.

When the air-conditioning controller 7 determines that the refrigerant recovery operation has not ended yet ("No" in step ST12), the air-conditioning controller 7 makes a determination in step ST12 again after a lapse of a predetermined time.

On the other hand, when the air-conditioning controller 7 determines that the refrigerant recovery operation has ended ("Yes" in step ST12), the air-conditioning controller 7 closes the gas-side shutoff valve 18 and then transmits to the management apparatus 60 end information indicating that the refrigerant recovery operation has ended (step ST13). The processing thus ends.

When the management apparatus 60 receives the end information from the air-conditioning controller 7, the management apparatus 60 transmits the end information to the terminal 71 (step ST14). The processing thus ends. When the terminal 71 receives the end information, the service engineer or the like is able to know that the refrigerant recovery operation has ended.

According to the air conditioner disclosed in Patent Literature 1, when the outdoor unit becomes full of the refrigerant and the refrigerant recovery operation stops, so that all the recovered refrigerant cannot be sent to the outdoor unit, then, a service engineer attaches a recovery container to the refrigerant circuit independently of the outdoor unit to send the remaining recovered refrigerant to the recovery container. However, the service engineer occasionally leaves the site in order to, for example, conduct another work or go to another site during the refrigerant recovery operation. Therefore, if the refrigerant recovery operation stops since the outdoor unit becomes full of the refrigerant while the service engineer leaves the site, a situation occurs in which the remaining recovered refrigerant is not sent to the recovery container thereafter. In this case, the service engineer comes to know that the outdoor unit becomes full of the refrigerant, after returning to the site. Consequently, the service engineer, who has returned to the site, needs to attach the recovery container to the refrigerant circuit so as to restart the refrigerant recovery operation, which may result in poor workability.

An object of the present disclosure is to provide an air-conditioning management system and a refrigerant recovery management apparatus each capable of improving workability in recovering a refrigerant.

Functional Effects of Embodiment

In the air-conditioning management system 1 according to this embodiment, the terminal 71 notifies, based on the notification command received from the management apparatus 60, the service engineer or the like that all the recovered refrigerant is not sendable to the recovery units 12 and 16. This notification allows the service engineer or the like to know that, before the start of the refrigerant recovery operation, all the refrigerant recovered from the refrigerant circuit 9 is not sendable to the recovery units 12 and 16. With this configuration, the service engineer or the like is able to recognize that he or she needs to previously attach the recovery container 10 to the refrigerant circuit 9 independently of the recovery units 12 and 16 or needs to return to the site for attaching the recovery container 10 after leaving the site once. The service engineer or the like is therefore able to conduct another work while scheduling this attaching work or is able to return to the site after receiving the notification and then attach the recovery container 10, which may improve workability in recovering the refrigerant.

In the case where the management apparatus 60 determines whether all the recovered refrigerant is sendable to the recovery units 12 and 16, based on the refrigerant information S2, the management apparatus 60 is capable of making this determination, based on whether a refrigerant is additionally supplied to the refrigerant circuit 9. The management apparatus 60 is therefore capable of making this determination with ease.

In the case where the management apparatus 60 determines whether all the recovered refrigerant is sendable to the recovery units 12 and 16, based on the pipe information S3, the management apparatus 60 is capable of making this determination, based on whether the total pipe length of the refrigerant circuit 9 has a value equal to or more than the threshold value. The management apparatus 60 is therefore capable of making this determination with ease.

The management apparatus 60 causes the air conditioning apparatus 2 to start the refrigerant recovery operation as long as the recovery container 10 capable of recovering the refrigerant is attached to the refrigerant circuit 9 independently of the recovery units 12 and 16 even when all the recovered refrigerant is not sendable to the recovery units 12 and 16. With this configuration, the service engineer or the like is able to conduct another work or to go to another site until the refrigerant recovery has been completed, which may further improve workability in recovering the refrigerant.

[Modification]

Figure 5:
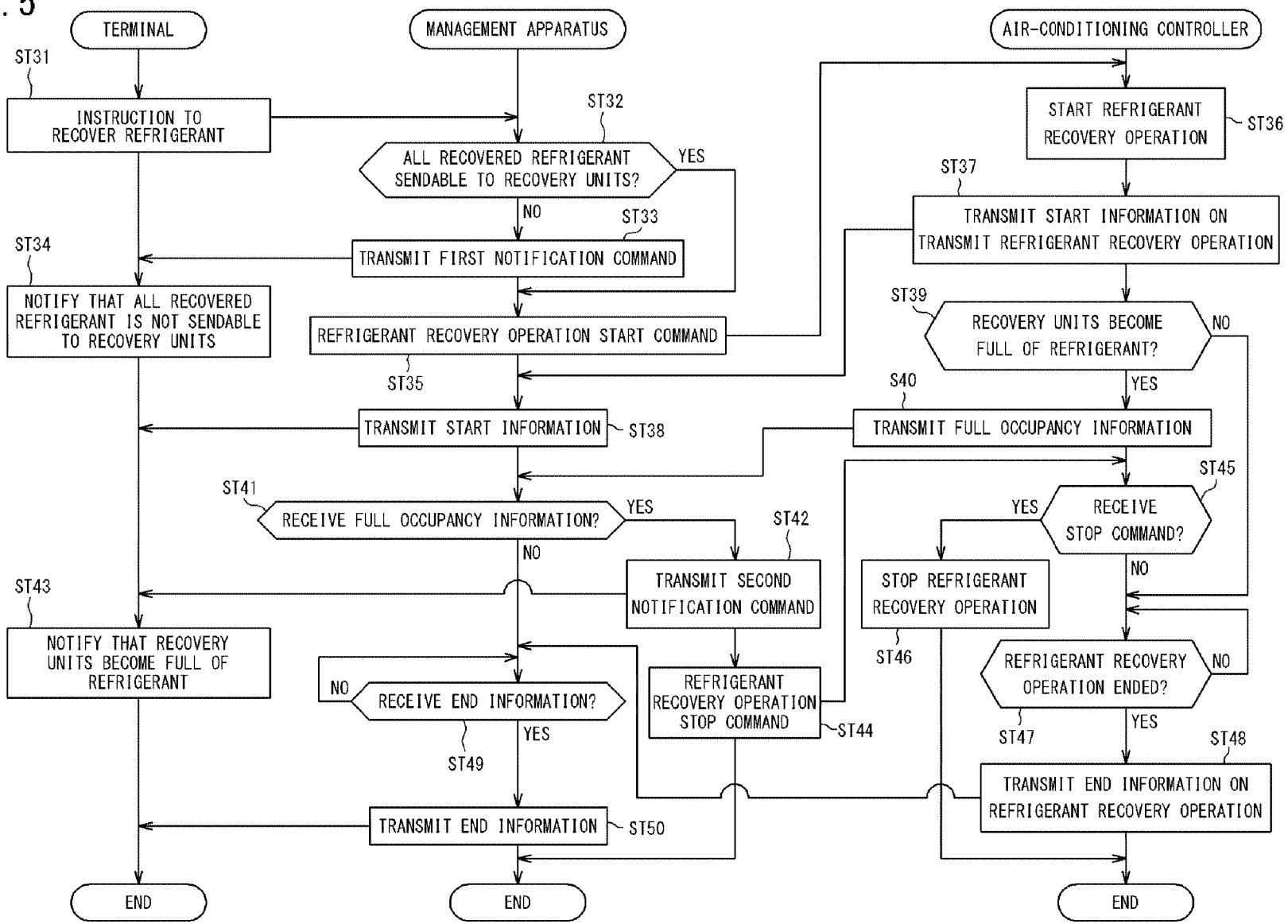
FIG. 5 is a sequence diagram illustrating a modification of the control example during the refrigerant recovery operation in the air-conditioning management system.

FIG. 5 is a sequence diagram illustrating a modification of the control example during the refrigerant recovery operation in the air-conditioning management system 1. This modification is different from the control example illustrated in FIG. 4 in the respect that the refrigerant recovery operation is carried out until the recovery units 12 and 16 become full of the refrigerant even when all the recovered refrigerant is not sendable to the recovery units 12 and 16. Hereinafter, this modification will be described in detail.

The service engineer or the like transmits, through the terminal 71, an instruction to recover the refrigerant in the air conditioning apparatus 2 to the management apparatus 60 (step ST31). When the management apparatus 60 receives the instruction from the terminal 71, the management apparatus 60 determines whether all the refrigerant recovered from the refrigerant circuit 9 is sendable to the recovery units 12 and 16 (step ST32). The specific determination method has already been described above.

When the management apparatus 60 determines that all the recovered refrigerant is sendable to the recovery units 12 and 16 ("Yes" in step ST32), the processing proceeds to step ST35 to be described later. On the other hand, when the management apparatus 60 determines that all the recovered refrigerant is not sendable to the recovery units 12 and 16 ("No" in step ST32), the management apparatus 60 transmits a first notification command for notifying this determination to the terminal 71 (step ST33).

The terminal 71 notifies, based on the first notification command received from the management apparatus 60, the service engineer or the like that all the recovered refrigerant is not sendable to the recovery units 12 and 16, by phonetic representation, textural representation, or the like (step ST34). The service engineer or the like is thus able to know that all the recovered refrigerant is not sendable to the recovery units 12 and 16.

The management apparatus 60 transmits to the air-conditioning controller 7 a start command for starting the refrigerant recovery operation, after transmitting the first notification command to the terminal 71 (step ST35).

It should be noted that when the management apparatus 60 receives from the terminal 71 the instruction to recover the refrigerant (step ST31), the management apparatus 60 may transmit to the air-conditioning controller 7 the start command for starting the refrigerant recovery operation, before starting to make the determination in step ST32. The management apparatus 60 may transmit to the air-conditioning controller 7 the start command for starting the refrigerant recovery operation, after receiving from the terminal 71 the instruction to receive the refrigerant.

When the air-conditioning controller 7 receives the start command, the air-conditioning controller 7 starts the refrigerant recovery operation of the air conditioning apparatus 2 (step ST36). The air-conditioning controller 7 then transmits to the management apparatus 60 start information indicating that the air conditioning apparatus 2 starts to carry out the refrigerant recovery operation (step ST37).

When the management apparatus 60 receives the start information from the air-conditioning controller 7, the management apparatus 60 transmits the start information to the terminal 71 (step ST38). When the terminal 71 receives the start information, the service engineer or the like is able to know that the refrigerant recovery operation has started.

The air-conditioning controller 7 determines whether the recovery units 12 and 16 become full of the refrigerant, after transmitting the start information (step ST39). In the air-conditioning controller 7 (see FIG. 3), specifically, the control unit 52 determines, based on detection signals of the discharge pressure sensor 26 and discharge temperature sensor 27, the detection signals being contained in the operation information S4 stored in the storage unit 53, that the recovery units 12 and 16 become full of the refrigerant when a discharge pressure and a discharge temperature at the compressor 11 respectively increase to threshold values. Alternatively, the control unit 52 determines that the recovery units 12 and 16 do not become full of the refrigerant yet when the discharge pressure and the discharge temperature at the compressor 11 do not respectively increase to the threshold values.

When the air-conditioning controller 7 determines that the recovery units 12 and 16 do not become full of the refrigerant yet ("No" in step ST39), the processing proceeds to step ST47 to be described later. On the other hand, when the air-conditioning controller 7 determines that the recovery units 12 and 16 become full of the refrigerant ("Yes" in step ST39), the air-conditioning controller 7 transmits to the management apparatus 60 full occupancy information indicating that the recovery units 12 and 16 become full of the refrigerant (step ST40).

The management apparatus 60 determines whether to receive the full occupancy information from the air-conditioning controller 7 (i.e., whether the recovery units 12 and 16 become full of the refrigerant) (step ST41). When the management apparatus 60 receives no full occupancy information, the management apparatus 60 determines that the recovery units 12 and 16 do not become full of the refrigerant yet. The processing then proceeds to step ST49 to be described later. On the other hand, when the management apparatus 60 receives the full occupancy information, the management apparatus 60 determines that the recovery units 12 and 16 become full of the refrigerant, and transmits to the terminal 71 a second notification command for notifying that the recovery units 12 and 16 become full of the refrigerant (step ST42). In the management apparatus 60 (see FIG. 3), specifically, the control unit 62 outputs the second notification command notifying that the recovery units 12 and 16 become full of the refrigerant. The second notification command is transmitted from the communication unit 61 to the terminal 71 via the network 70.

The terminal 71 notifies, based on the second notification command received from the management apparatus 60, the service engineer or the like that the recovery units 12 and 16 become full of the refrigerant, by phonetic representation, textural representation, or the like (step ST43). The service engineer or the like is thus able to know that the recovery units 12 and 16 become full of the refrigerant.

It should be noted that the management apparatus 60 may transmit to the terminal 71 information indicating a refrigerant recovery state (e.g., a remaining time until the recovery units 12 and 16 become full of the refrigerant) before the recovery units 12 and 16 become full of the refrigerant.

The management apparatus 60 transmits to the air-conditioning controller 7 a stop command for stopping the refrigerant recovery operation, after transmitting the second notification command to the terminal 71 (step ST44). In the management apparatus 60 (see FIG. 3), specifically, the communication unit 61 transmits the second notification command to the terminal 71, and then the control unit 62 outputs the stop command for stopping the refrigerant recovery operation. The stop command is transmitted from the communication unit 61 to the air-conditioning controller 7 via the network 70. It should be noted that the management apparatus 60 may output the stop command before transmitting the second notification command to the terminal 71 in step ST42.

The air-conditioning controller 7 confirms whether to receive the stop command from the management apparatus 60 (step ST45). When the air-conditioning controller 7 receives the stop command from the management apparatus 60 ("Yes" in step ST45), the air-conditioning controller 7 stops the refrigerant recovery operation (step ST46). The processing then ends.

In stopping the refrigerant recovery operation, the air-conditioning controller 7 stops the compressor 11, outdoor fan 14, and indoor fans 43 being driven, as in the case of the refrigerant recovery operation. Thereafter, the air-conditioning controller 7 closes the gas-side shutoff valve 18. The air-conditioning controller 7 may transmit information indicating that the refrigerant recovery operation has stopped, to the terminal 71 via the management apparatus 60.

On the other hand, when the air-conditioning controller 7 does not receive the stop command from the management apparatus 60 ("No" in step ST45), the air-conditioning controller 7 determines whether the refrigerant recovery operation ends (step ST47). The specific determination method has already been described above. When the air-conditioning controller 7 determines that the refrigerant recovery operation has not ended yet ("No" in step ST47), the air-conditioning controller 7 makes a determination in step ST47 again after a lapse of a predetermined time.

When the air-conditioning controller 7 determines that the refrigerant recovery operation has ended ("Yes" in step ST47), the air-conditioning controller 7 closes the gas-side shutoff valve 18 and then transmits to the management apparatus 60 end information indicating that the refrigerant recovery operation has ended (step ST48). The processing thus ends. The management apparatus 60 confirms whether to receive the end information from the air-conditioning controller 7 (step ST49).

When the management apparatus 60 receives no end information from the air-conditioning controller 7 ("No" in step ST49), the management apparatus 60 makes a confirmation in step ST49 again after a lapse of a predetermined time.

When the management apparatus 60 receives the end information from the air-conditioning controller 7 ("Yes" in step ST49), the management apparatus 60 transmits the end information to the terminal 71 (step ST50). The processing then ends. When the terminal 71 receives the end information, the service engineer or the like is able to know that the refrigerant recovery operation has ended.

In the air-conditioning management system 1 according to this modification, in the case where the refrigerant recovery operation is carried out on condition that all the recovered refrigerant is not sendable to the recovery units 12 and 16, the terminal 71 notifies, based on the second notification command received from the management apparatus 60, the service engineer or the like that the recovery units 12 and 16 become full of the refrigerant. With this configuration, for example, the service engineer or the like conducting another work at the site during the refrigerant recovery operation is able to promptly grasp that the recovery units 12 and 16 become full of the refrigerant, by receiving the notification from the management apparatus 60. Therefore, the service engineer or the like is able to promptly attach the recovery container 10 for recovering the remaining refrigerant to the refrigerant circuit 9, which may further improve workability in recovering the refrigerant.

The management apparatus 60 stops the refrigerant recovery operation when the recovery units 12 and 16 become full of the refrigerant. For example, even in the case where the service engineer or the like conducts work at another site during the refrigerant recovery operation, therefore, the refrigerant recovery operation may be stopped when the recovery units 12 and 16 become full of the refrigerant. With this configuration, the service engineer or the like does not need to return to the site in order to stop the refrigerant recovery operation, which may further improve workability in recovering the refrigerant.

[Others]

According to the foregoing embodiment, when the management apparatus 60 receives from the terminal 71 an instruction to recover the refrigerant, the management apparatus 60 determines whether all the refrigerant recovered from the refrigerant circuit 9 is sendable to the recovery units 12 and 16. Alternatively, the management apparatus 60 may make this determination at any timing as long as the management apparatus 60 makes this determination before the start of the refrigerant recovery operation. For example, the management apparatus 60 may make the determination only when receiving the determination instruction from the terminal 71.

According to the foregoing embodiment, the control unit 62 of the management apparatus 60 functions as the control unit that makes a determination whether all the recovered refrigerant is sendable to the recovery units 12 and 16. Alternatively, the control unit 52 of the air-conditioning controller 7 may function as the control unit that makes this determination. In this case, the input unit 54 of the air-conditioning controller 7 may provide an instruction to recover the refrigerant.

Alternatively, both the control unit 52 of the air-conditioning controller 7 and the control unit 62 of the management apparatus 60 may function as the control unit that makes the determination described above. For example, the control unit 52 of the air-conditioning controller 7 may determine whether all the recovered refrigerant is sendable to the recovery units 12 and 16, and the control unit 62 of the management apparatus 60 may output a notification command, based on a result of the determination.

According to the foregoing embodiment, the storage unit 63 of the management apparatus 60 functions as the storage unit that stores the refrigerant information S2 and the like. Alternatively, the storage unit 53 of the air-conditioning controller 7 may function as the storage unit that stores the refrigerant information S2 and the like.

Alternatively, both the storage unit 53 of the air-conditioning controller 7 and the storage unit 63 of the management apparatus 60 may function as the storage unit that stores the refrigerant information S2 and the like. For example, the storage unit 53 of the air-conditioning controller 7 may store the refrigerant information S2, and the storage unit 63 of the management apparatus 60 may store the pipe information S3.

The present disclosure is not limited to the foregoing exemplary description, and all changes that fall within metes and bounds of the claims, or equivalence such metes and bounds thereof are therefore intended to be embraced by the claims.

REFERENCE SIGNS LIST

1 air-conditioning management system
2 air conditioning apparatus
3 outdoor unit
4 indoor unit
9 refrigerant circuit
10 recovery container
12 outdoor heat exchanger (recovery unit)
16 accumulator (recovery unit)
60 management apparatus (refrigerant recovery management apparatus)
62 control unit
63 storage unit
S2 refrigerant information
S3 pipe information

The invention claimed is:

1. An air-conditioning management system comprising:

an air conditioning apparatus configured to carry out a refrigerant recovery operation of recovering a refrigerant from a refrigerant circuit that connects an outdoor unit and an indoor unit and sending the recovered refrigerant to a recovery unit of the outdoor unit; and a control unit configured to make a determination whether all the recovered refrigerant is sendable to the recovery unit before a start of the refrigerant recovery operation by the air conditioning apparatus, and to output, when determining that all the recovered refrigerant is not sendable to the recovery unit, a command for notifying the determination.

2. The air-conditioning management system according to claim 1, further comprising a refrigerant recovery management apparatus communicably connected to the air conditioning apparatus, wherein the refrigerant recovery management apparatus includes the control unit.

3. The air-conditioning management system according to claim 1, further comprising a storage unit storing refrigerant information indicating whether a refrigerant is additionally supplied to the refrigerant circuit, wherein the control unit makes the determination, based on the refrigerant information stored in the storage unit.

4. The air-conditioning management system according to claim 1, further comprising a storage unit storing pipe information indicating a total pipe length of the refrigerant circuit, wherein the control unit makes the determination, based on the pipe information stored in the storage unit.

5. The air-conditioning management system according to claim 1, wherein when the control unit determines that all the recovered refrigerant is not sendable to the recovery unit, the control unit determines whether a recovery container capable of recovering the refrigerant is attached to the refrigerant circuit independently of the recovery unit, and when the control unit determines that the recovery container is attached to the refrigerant circuit, the control unit outputs a command for starting the refrigerant recovery operation.

6. The air-conditioning management system according to claim 1, wherein the control unit outputs to the air conditioning apparatus a command for starting the refrigerant recovery operation, the control unit determines whether the recovery unit becomes full of the refrigerant, after outputting the command, and when the control unit determines that the recovery unit becomes full of the refrigerant, the control unit outputs a command for notifying that the recovery unit becomes full of the refrigerant.

7. The air-conditioning management system according to claim 1, wherein the control unit outputs to the air conditioning apparatus a command for starting the refrigerant recovery operation, the control unit determines whether the recovery unit becomes full of the refrigerant, after outputting the command, and when the control unit determines that the recovery unit becomes full of the refrigerant, the control unit outputs to the air conditioning apparatus a command for stopping the refrigerant recovery operation.

8. The air-conditioning management system according to claim 2, further comprising a storage unit storing refrigerant information indicating whether a refrigerant is additionally supplied to the refrigerant circuit, wherein the control unit makes the determination, based on the refrigerant information stored in the storage unit.

9. The air-conditioning management system according to claim 2, further comprising a storage unit storing pipe information indicating a total pipe length of the refrigerant circuit, wherein the control unit makes the determination, based on the pipe information stored in the storage unit.

10. The air-conditioning management system according to claim 2, wherein when the control unit determines that all the recovered refrigerant is not sendable to the recovery unit, the control unit determines whether a recovery container capable of recovering the refrigerant is attached to the refrigerant circuit independently of the recovery unit, and when the control unit determines that the recovery container is attached to the refrigerant circuit, the control unit outputs a command for starting the refrigerant recovery operation.

11. The air-conditioning management system according to claim 3, wherein when the control unit determines that all the recovered refrigerant is not sendable to the recovery unit, the control unit determines whether a recovery container capable of recovering the refrigerant is attached to the refrigerant circuit independently of the recovery unit, and when the control unit determines that the recovery container is attached to the refrigerant circuit, the control unit outputs a command for starting the refrigerant recovery operation.

12. The air-conditioning management system according to claim 4, wherein when the control unit determines that all the recovered refrigerant is not sendable to the recovery unit, the control unit determines whether a recovery container capable of recovering the refrigerant is attached to the refrigerant circuit independently of the recovery unit, and when the control unit determines that the recovery container is attached to the refrigerant circuit, the control unit outputs a command for starting the refrigerant recovery operation.

13. The air-conditioning management system according to claim 2, wherein the control unit outputs to the air conditioning apparatus a command for starting the refrigerant recovery operation, the control unit determines whether the recovery unit becomes full of the refrigerant, after outputting the command, and when the control unit determines that the recovery unit becomes full of the refrigerant, the control unit outputs a command for notifying that the recovery unit becomes full of the refrigerant.

14. The air-conditioning management system according to claim 3, wherein the control unit outputs to the air conditioning apparatus a command for starting the refrigerant recovery operation, the control unit determines whether the recovery unit becomes full of the refrigerant, after outputting the command, and when the control unit determines that the recovery unit becomes full of the refrigerant, the control unit outputs a command for notifying that the recovery unit becomes full of the refrigerant.

15. The air-conditioning management system according to claim 4, wherein the control unit outputs to the air conditioning apparatus a command for starting the refrigerant recovery operation, the control unit determines whether the recovery unit becomes full of the refrigerant, after outputting the command, and when the control unit determines that the recovery unit becomes full of the refrigerant, the control unit outputs a command for notifying that the recovery unit becomes full of the refrigerant.

16. The air-conditioning management system according to claim 2, wherein the control unit outputs to the air conditioning apparatus a command for starting the refrigerant recovery operation, the control unit determines whether the recovery unit becomes full of the refrigerant, after outputting the command, and when the control unit determines that the recovery unit becomes full of the refrigerant, the control unit outputs to the air conditioning apparatus a command for stopping the refrigerant recovery operation.

17. The air-conditioning management system according to claim 3, wherein the control unit outputs to the air conditioning apparatus a command for starting the refrigerant recovery operation, the control unit determines whether the recovery unit becomes full of the refrigerant, after outputting the command, and when the control unit determines that the recovery unit becomes full of the refrigerant, the control unit outputs to the air conditioning apparatus a command for stopping the refrigerant recovery operation.

18. The air-conditioning management system according to claim 4, wherein the control unit outputs to the air conditioning apparatus a command for starting the refrigerant recovery operation, the control unit determines whether the recovery unit becomes full of the refrigerant, after outputting the command, and when the control unit determines that the recovery unit becomes full of the refrigerant, the control unit outputs to the air conditioning apparatus a command for stopping the refrigerant recovery operation.

19. The air-conditioning management system according to claim 6, wherein the control unit outputs to the air conditioning apparatus a command for starting the refrigerant recovery operation, the control unit determines whether the recovery unit becomes full of the refrigerant, after outputting the command, and when the control unit determines that the recovery unit becomes full of the refrigerant, the control unit outputs to the air conditioning apparatus a command for stopping the refrigerant recovery operation.

20. A refrigerant recovery management apparatus to be communicably connected to an air conditioning apparatus configured to carry out a refrigerant recovery operation of recovering a refrigerant from a refrigerant circuit that connects an outdoor unit and an indoor unit and sending the recovered refrigerant to a recovery unit of the outdoor unit, the refrigerant recovery management apparatus comprising a control unit configured to make a determination whether all the recovered refrigerant is sendable to the recovery unit before a start of the refrigerant recovery operation by the air conditioning apparatus, and to output, when determining that all the recovered refrigerant is not sendable to the recovery unit, a command for notifying the determination.

* * * * *